United States Patent [19]

Janecek et al.

[11] 4,173,335

[45] Nov. 6, 1979

[54] DRIVE MECHANISM FOR A SHEET FEEDER DEVICE

[75] Inventors: Jaroslav Janecek, Brno; Jaroslav Jiruse, Blansko, both of Czechoslovakia

[73] Assignee: Adamovske strojirny, narodni podnik, Prague, Czechoslovakia

[21] Appl. No.: 809,803

[22] Filed: Jun. 24, 1977

[30] Foreign Application Priority Data

Jul. 19, 1976 [CS] Czechoslovakia ..... 4750-76

[51] Int. Cl.[2] ..... B65H 3/08

[52] U.S. Cl. ..... 271/93; 271/12

[58] Field of Search ..... 271/93, 92, 91, 90, 271/98, 107, 30 R, 31, 11, 12

[56] References Cited

U.S. PATENT DOCUMENTS

| | | | |
|---|---|---|---|
| 2,000,261 | 5/1935 | Spiess | 271/93 |
| 2,208,304 | 7/1940 | Goodwin | 271/30 |
| 2,645,479 | 7/1953 | Mitchell | 271/91 |
| 3,558,126 | 1/1971 | Jiruse | 271/98 |
| 3,912,258 | 10/1975 | Martin | 271/184 |

*Primary Examiner*—Bruce H. Stoner, Jr.

*Attorney, Agent, or Firm*—Burgess, Ryan and Wayne

[57] ABSTRACT

A sheet feeder drive for transferring paper sheets from a pile to a feeder device which is driven by a common drive shaft which enables adjustment of the feeder according to paper size and also enables the vertical setting of the feeder.

1 Claim, 2 Drawing Figures

DRIVE MECHANISM FOR A SHEET FEEDER DEVICE

BACKGROUND OF THE INVENTION

The invention relates to a drive mechanism for a sheet feeder device and its arrangement on a rotary printing machine.

A pneumatic sheet feeder device transfers the paper sheet from a pile and transports the sheet to the transport device which brings the sheets in superimposed arrangement to the printing cylinders.

The scope of the present invention is to provide a drive mechanism for a sheet feeder device consisting of a box, in which the mechanisms of the sheet feeder are arranged which are driven by a common drive shaft which enables the adjustment of the feeder device according to the size of the paper sheet to be printed and also enables the vertical setting of the feeder device.

Sheet feeder devices are known which are driven by means of a push crankshaft which allows for changing the position of the feeder device. The drive shaft of this device is arranged in such a way that the longitudinal axis of the shaft is located vertically to the direction of the movement of the fed sheets to be printed.

A disadvantage of the named device resides in the fact that the rotation of the drive shaft and that of the whole feeder device are not equal due to the influence of the push crankshaft. Also the production of the push crankshaft is complicated and expensive.

A further disadvantage of the device is that there arises during the adjustment of the feeder device a shifting (displacement) of the whole working cycle of the feeder device relative to the working cycle of the printing cylinders.

Another known sheet feeder device comprises a drive shaft which is arranged in such a way, that the longitudinal axis is parallely arranged with the horizontal plane of the sheet pile in the direction of the feeding of the paper sheets. The drive of the shaft is carried out by means of gears and by a rigid connecting shaft. The rotary movement and with this also the operation of the whole sheet feeder device is uniform.

A disadvantage of this feeder device is that the drive shaft, when the device is set for sheets of smaller size (form), is shifted out over the transport device, so that access to the device by the operator is impossible. Another disadvantage is that the rigid connecting shaft makes an adjustment of the feeder device according to the height impossible.

A further known feeder device is arranged on a carrier bracket which is fixed in the side wall of the printing machine. In a special box which also is attached to the side wall of the machine, there is arranged the drive for all mechanisms of the sheet feeder device which are arranged and controlled by means of pull rods.

A disadvantage of the device is in that it cannot be adjusted for height for the reason that while adjustment of the mechanisms should be shifted in their working position, this cannot be done due to the rigid connection of the pull rods.

SUMMARY OF THE INVENTION

The named disadvantages are avoided by a drive for a feeder device according to the present invention, where a gear is rotatably and shiftably mounted on a drive shaft which is rotatably arranged in bearings fixed in side walls of the machine. The gear engages with a connecting gear which is fixed on a shaft, one end of which being mounted in a bearing and the other end of the shaft being shiftably mounted in a coupling which is rigidly connected with a transfer gear which is in engagement with a driven gear fixed on a drive shaft which is parallely arranged with the drive shaft and is rotatably mounted in a body of a box which is shiftably arranged by means of guide bars on a support, whereby the guide bars are connected by means of a securing bolt. On the end parts of the support, there are mounted slides provided with chains which engage with rollers which are fixed on a (control) shaft mounted in the side walls of the printing machine. A drive gear is rotatably mounted with its hub in an angular bearing. The drive gear is circumferentially provided with a groove, in which with its fork end part is located a carrier which is rigidly attached on the slides. The direction of rotation of the driven gear is the same as the direction of rotation of the drive gear.

The advantage of the drive mechanism according to the present invention is that while adjusting the feeder device for paper sheets of smaller size (form), the parts of the drive mechanism do not interfere (protrude) in the space over the feeder device, so that the whole feeder device is easily accessible.

A further advantage of the drive mechanism is that the arrangement of the mechanism enables by means of easily accessible control elements a continual vertical adjustment as well as an adjustment of the feeder device according to the size of the fed paper sheets.

Another advantage resides that while adjustment of the feeder device secures a uniform operation of the feeder mechanism such adjustment does not cause a shifting of the working cycle relative to the printing unit. The mounting and the dismantling of the feeder device, being in this case a completely mounted unit, is achieved by only a simple operation of only disengageing the coupling from the connecting shaft, whereby a dismantling of the drive is not necessary.

BRIEF DESCRIPTION OF THE DRAWING

A specific example of an embodiment of the invention will now be described with reference to the accompanying drawings in which.

DESCRIPTION OF THE PREFERRED EMBODIMENT

Figure 1:
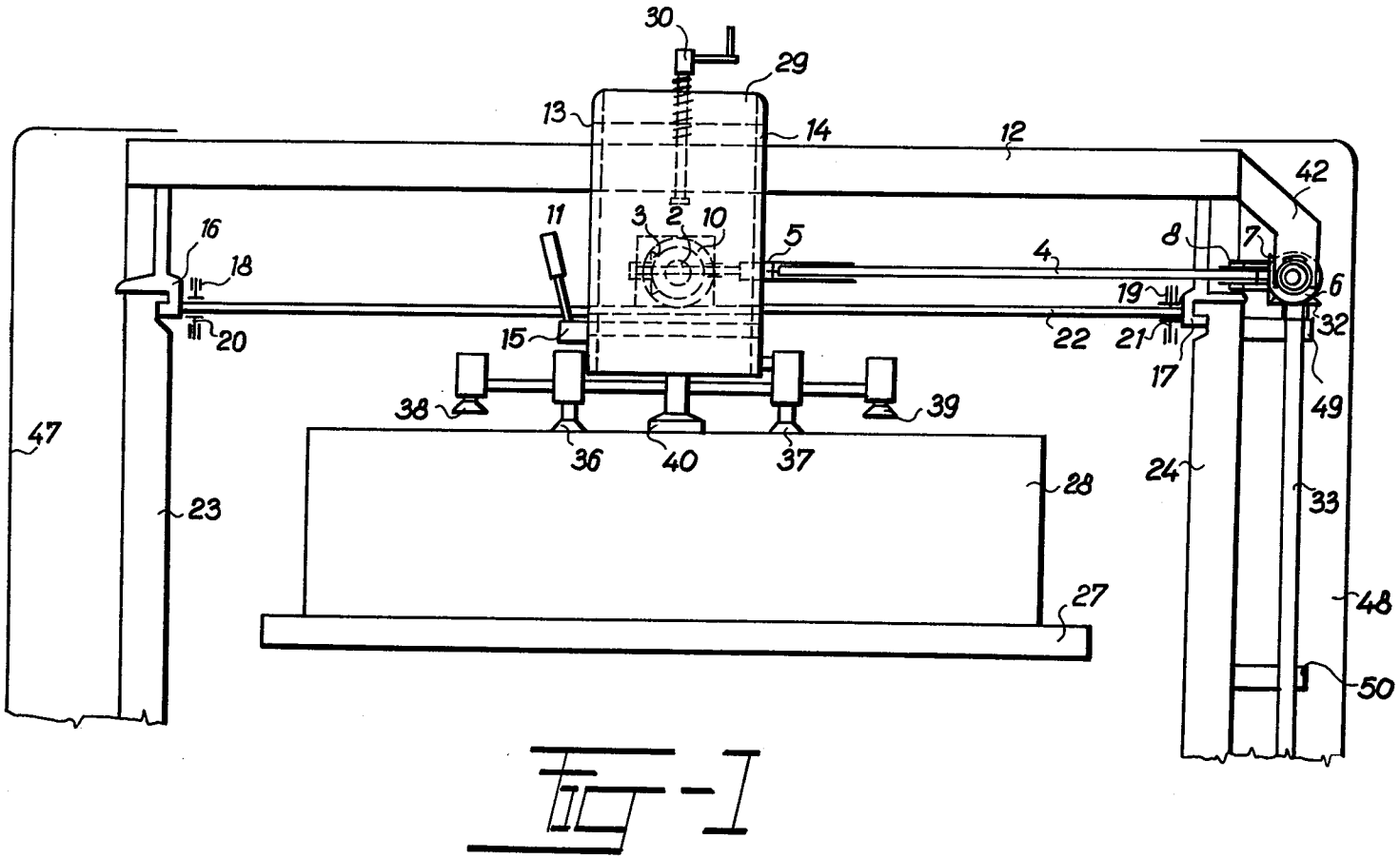
FIG. 1 shows a front view of the drive mechanism of the feeder device.
Figure 2:
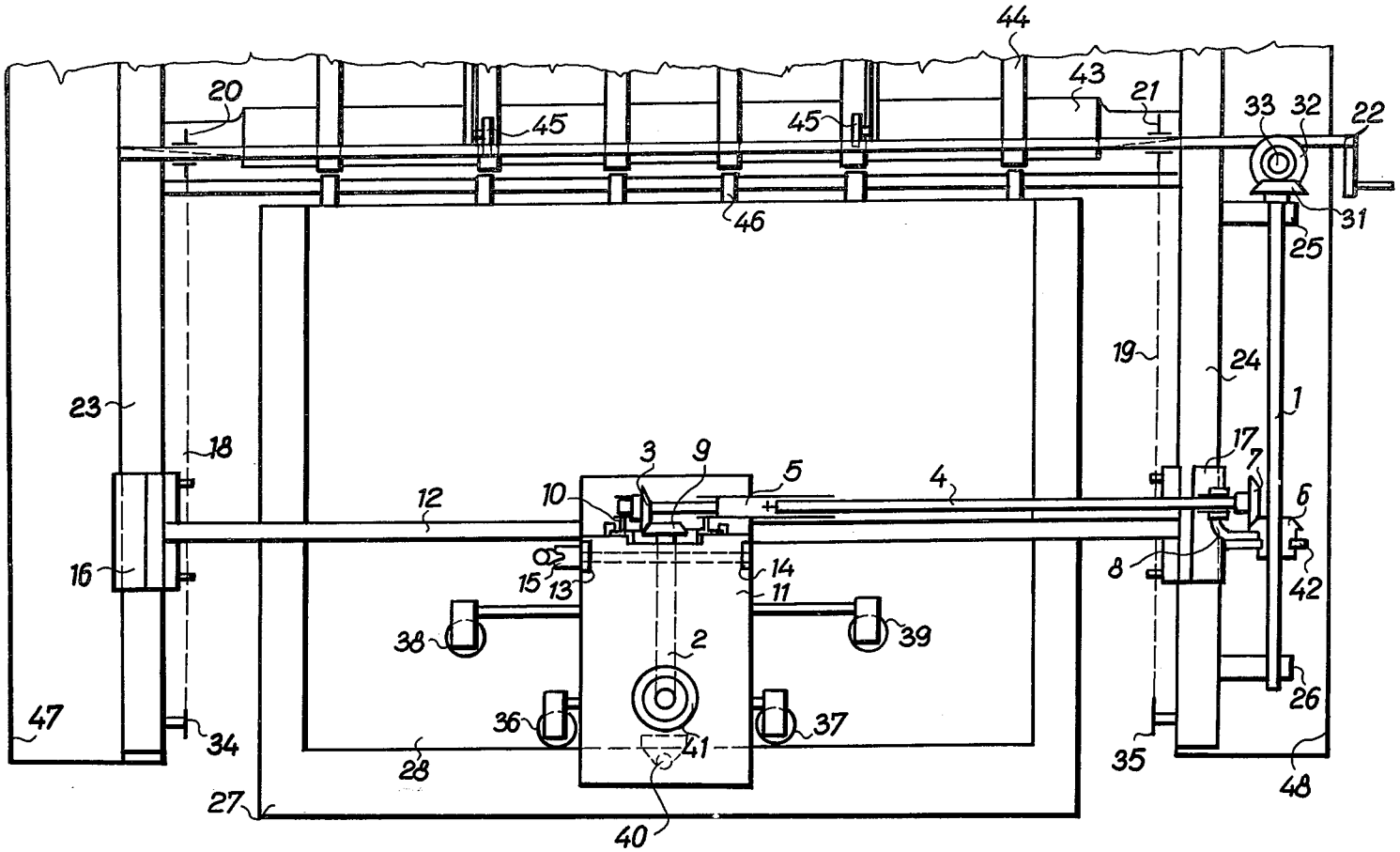
FIG. 2 is a plan view in partial section of FIG. 1.

The drive mechanism of the feeder device according to the invention consists of a drive shaft 1 which is rotary mounted in bearings 25, 26 which are attached in side walls 24. On the drive shaft 1 is shiftably mounted a drive gear 6 which engages with a connecting gear 7 fixed on a connecting shaft 4. The connecting shaft 4 has one end mounted in a bearing 8 and with the other end shiftably arranged in a coupling 5. In the bearing 8 also is arranged with its hub the gear 6. The coupling 5 is rigidly connected with a transfer gear 3 which engages with a driven gear 9 which is fixed on a driven shaft 2. The driven shaft 2 is parallely arranged with the drive shaft 1, whereby the direction of rotation of the driven gear 9 is the same as the direction of rotation of the drive gear 6. The coupling 5 is arranged in a swing out bearing 10 which is mounted in the body of a box 11. The box 11 is shiftably arranged on guide bars 13, 14 which are connected by means of a securing screw 15. The guide bars 13, 14 are attached on a holder 29 which is fixed on support 12 mounted on the side walls 23, 24 of the machine. In the support 12 there is provided a guide screw 30 for the vertical displacement of the body of the box 11. On slides 16, 17 there are fixed chains 18, 19 which are guided with one end on rollers 34, 35, with the other end the chains being in engagement with the rollers 20, 21. The rollers 20 and 21 are fixed on a shaft 22 which is rotatably mounted in side walls 23, 24. On the slide 17 is fixed a carrier 42, one end of which has the form of a fork which engages in a circumferential groove which is provided on the hub of the drive gear 6. On one end of the drive shaft 1, there is fixed a drive gear 31 which meshes with the drive gear 32. The drive gear 32 is fixed on a countershaft 33 which is connected with a not illustrated countershaft. The Countershaft 33 is rotatably mounted in bearings 49, 50 which are fixed in side wall 24 of the machine. In the body of the box 11 is rotatably mounted a drive shaft 2, on which are arranged not illustrated cams and other mechanisms of the feeder device. On the side walls of the body of the box 11 are arranged lifting suckers 36, 37 and on the lower side of the body (bottom) of the box 11 are attached suckers 38, 39 by means of a suction rod and a feeler 40. On the upper side of the box 11 is arranged a pneumatic valve 41. On the feeder table 27 sheets are arranged in a pile 28 in such a way that they reach with their front edges to the swing stop 46.

The feeder device is followed by the transport device which comprises a transport roller 43, transport chains 44*a* and rollers 45. On side walls 23, 24 are attached shields (casings) 47, 48.

The function of the drive mechanism of the feeder device is the following:

The rotary motion of the gear 31 is derived from a not illustrated drive and is transferred by means of a countershaft 33 and a countershaft gear 32 to the drive shaft 1 from which the rotary motion is further transferred by means of the drive gear 6 on the connecting gear 7 and by this also on the connecting shaft 4. The rotation is transferred from the connecting shaft 4 by means of the coupling 5 to the transfer gear 3 which engages with the driven gear 9 which is fixed on the driven shaft 2. From the driven shaft 2 the rotary motion is transferred on not illustrated cams which are fixed on said shaft 2. The not illustrated cams control the motion of the lifting suckers 36, 37, of the feed suckers 38, 39 and of the feeler 40 and the pneumatic valve 41. The lifting suckers 36, 37 lift the single paper sheet from the pile 28.

The feeder suckers 38, 39 bring the paper sheet to the feeder device which transports the sheets by means of transport bands 44 to the printing cylinders. The horizontal adjustment of the feeder device according to the size of the paper sheets to be printed is carried out by turning of the control shaft 22 by which are turned also the rollers 20, 21 which move the chains 18, 19. By means of the chains 18, 19 the slides 16, 17 with the support 12 are set (adjusted) and by this also the whole feeder device is adjusted in the required position. The carrier 42 simultaneously shifts the drive gear 6, the bearing 8 and in this way also the adjacent part of the drive mechanism.

The vertical adjustment of the feeder device is carried out by the turning of the guide screw 30 by which the body of the box 11 is shifted on the guide bars 13, 14 and by this the whole feeder device is adjusted in the required position. The feeder device is secured in the adjusted position by means of the securing screw 15. When the feeder device is to be adjusted vertically, the connecting gear 7 is turned and simultaneously with the gear also the transfer gear 3 is turned, so that the meshing drive gear 6 and the driven gear 9 is rotated for the same value of the circumferential distance. In this way it is achieved that the mutual position of the drive shaft 1 and driven shaft 2 is not changed during the adjustment operation. A minimum distance change between the drive shaft 1 and the driven shaft 2, which is created by the adjustment between the drive shaft 1 and the driven shaft 2, is compensated by the pushing out or pushing (inside) of the shaft 4 into the coupling 5.

What we claim is:

1. A sheet feeder drive for transferring paper sheets from a pile thereof to a feeder device by means of pneumatic suckers, comprising:

a pair of spaced apart vertically oriented side walls straddling said pile of paper sheets;

first and second slides mounted adjacent the top edges of respective ones of said side walls;

a horizontal main drive shaft mounted for rotation in bearings affixed to one of said side walls, said drive shaft being disposed adjacent said first slide;

a drive gear rotatably and slidably mounted on said drive shaft;

elongated support means disposed above said pile of paper sheets, connected between said side walls, and slidably coupled to said slides for horizontal movement in a direction parallel to said side walls;

housing means slidably mounted on said support means;

a driven shaft rotatably mounted to said housing means and parallel to said drive shaft;

a driven gear mounted on one end of said driven shaft;

a transmitting gear engaging said driven gear;

a connecting shaft parallel to said support means and extending between said one of said side walls and said housing, said connecting shaft being rotatably mounted to said first slide at one end thereof;

a coupling having a first end slidably coupled to the other end of said connecting shaft and a second end supported by a swing out bearing disposed in said housing, said coupling being connected to said transmitting gear adjacent said second end thereof;

means comprising a guide screw connected between said support means and said housing for effecting movement of said housing in a vertical direction;

chain means for effecting coordinated movement of said first and second slides;

a control shaft rotationally supported by said side walls;

a pair of rollers mounted to said control shaft adjacent opposite ends thereof for driving said chain means;

said drive gear having a circumferential groove on the hub thereof; and a carrier fixed at one end thereof to said first slide and being forked at the other end thereof, said forked end engaging said groove.

* * * * *